US007364681B2

(12) United States Patent
Zikeli et al.

(10) Patent No.: US 7,364,681 B2
(45) **Date of Patent: *Apr. 29, 2008**

(54) SPINNING DEVICE AND METHOD HAVING COOLING BY BLOWING

(76) Inventors: Stefan Zikeli, Schacha 14, A-4844 Regau (AT); Friedrich Ecker, St. Anna Strasse 10, A-4850 Timelkam (AT)

( * ) Notice: Subject to any disclaimer, the term of this patent is extended or adjusted under 35 U.S.C. 154(b) by 0 days.

This patent is subject to a terminal disclaimer.

(21) Appl. No.: 10/500,998

(22) PCT Filed: Nov. 11, 2002

(86) PCT No.: PCT/EP02/12591

§ 371 (c)(1),
(2), (4) Date: Oct. 7, 2004

(87) PCT Pub. No.: WO03/057951

PCT Pub. Date: Jul. 17, 2003

(65) Prior Publication Data

US 2005/0035487 A1 Feb. 17, 2005

(30) Foreign Application Priority Data

Jan. 8, 2002 (DE) ..... 102 00 405

(51) Int. Cl.
*D01D 4/02* (2006.01)
*D01D 5/06* (2006.01)
*D01D 13/00* (2006.01)
*D01F 2/02* (2006.01)

(52) U.S. Cl. ..... 264/187; 264/203; 264/211.12; 264/211.14; 425/71; 425/72.2

(58) Field of Classification Search ..... 264/187, 264/203, 211.12, 211.14, 211.16; 425/71, 425/72.2

See application file for complete search history.

(56) References Cited

U.S. PATENT DOCUMENTS 1,655,433 A 1/1928 Morris (Continued)

FOREIGN PATENT DOCUMENTS

AT 395 724 2/1993

(Continued)

OTHER PUBLICATIONS

International Search Report for International Application No. PCT/EP03/02946 Issued on Jul. 29, 2003.

(Continued)

*Primary Examiner*—Leo B. Tentoni
(74) *Attorney, Agent, or Firm*—Michael Best & Friedrich LLP

(57) ABSTRACT

The present invention relates to an apparatus for producing continuously molded bodies from a molding material, such as a spinning solution containing cellulose, water and tertiary amine oxide. The apparatus (1) comprises a die plate (3) including extrusion orifices (4) through which the molding material is extruded into substantially filament-like continuously molded bodies (5). The continuously molded bodies (5) are passed through an air gap (6) and guided in a precipitation bath (9) by a deflector (10) to a bundling means (12) where they are united into a bundle of fibers. In the air gap, a blowing means (14) is provided for directing a cooling gas stream (15) onto the continuously molded bodies (5) in a direction transverse to the direction of passage (7). To improve the spinning stability and mechanical properties of the continuously molded bodies, it is intended according to the invention that directly with respect to the extrusion orifices (4) a first shielding zone (20) is arranged by which the extrusion orifices are shielded against the action of the cooling gas stream.

24 Claims, 3 Drawing Sheets

U.S. PATENT DOCUMENTS

| | | | | |
|---|---|---|---|---|
| 1,765,883 | A | 6/1930 | Ruschke | |
| 2,179,181 | A | 11/1939 | Graenacher et al. | |
| 2,518,827 | A | 8/1950 | Smith | |
| 3,061,402 | A | 10/1962 | Sanders | |
| 3,404,698 | A | 10/1968 | Rouse | |
| 3,924,984 | A | 12/1975 | Giacobazzi | |
| 3,932,576 | A | 1/1976 | Patel | |
| 4,033,742 | A | 7/1977 | Nichols et al. | |
| 4,043,718 | A | 8/1977 | Takenaka et al. | |
| 4,142,913 | A | 3/1979 | McCorsley, III et al. | |
| 4,144,080 | A | 3/1979 | McCorsley, III et al. | |
| 4,193,962 | A | 3/1980 | Roberts | |
| 4,211,574 | A | 7/1980 | McCorsley, III et al. | |
| 4,219,040 | A | 8/1980 | Fallon et al. | |
| 4,246,221 | A | 1/1981 | McCorsley, III | |
| 4,261,941 | A | 4/1981 | Sherman et al. | |
| 4,261,943 | A | 4/1981 | McCorsley, III | |
| 4,263,929 | A | 4/1981 | Kearney | |
| 4,416,698 | A | 11/1983 | McCorsley, III | |
| 4,477,951 | A | 10/1984 | Geyer, Jr. et al. | |
| 4,529,368 | A | 7/1985 | Makansi | |
| 4,713,290 | A | 12/1987 | Kwon et al. | |
| 4,869,860 | A | 9/1989 | Lewis, Jr. | |
| 5,191,990 | A | 3/1993 | Fritts | |
| 5,252,284 | A | 10/1993 | Jurkovic et al. | |
| 5,275,545 | A | 1/1994 | Ohyanagi et al. | |
| 5,607,639 | A * | 3/1997 | Zikeli et al. | 264/203 X |
| 5,639,484 | A | 6/1997 | White et al. | |
| 5,658,524 | A | 8/1997 | Portnoy et al. | |
| 5,792,399 | A | 8/1998 | Meister et al. | |
| 5,968,434 | A | 10/1999 | Zikeli et al. | |
| 5,984,655 | A | 11/1999 | Schwenninger et al. | |
| 6,117,379 | A | 9/2000 | Haynes et al. | |
| 6,173,767 | B1 | 1/2001 | Kennon | |
| 6,706,224 | B2 * | 3/2004 | Firgo et al. | 264/103 |
| 2002/0025433 | A1 * | 2/2002 | Chang et al. | 264/211.14 X |
| 2003/0025252 | A1 | 2/2003 | Sealey et al. | |
| 2005/0048151 | A1 | 3/2005 | Zikeli et al. | |
| 2005/0051210 | A1 | 3/2005 | Zikeli et al. | |
| 2005/0220916 | A1 | 10/2005 | Zikeli et al. | |
| 2006/0055078 | A1 | 3/2006 | Zikeli et al. | |
| 2006/0083918 | A1 | 4/2006 | Zikeli et al. | |
| 2006/0144062 | A1 | 7/2006 | Zikeli et al. | |

FOREIGN PATENT DOCUMENTS

| | | |
|---|---|---|
| DE | 858 005 | 12/1952 |
| DE | 2 014 828 | 10/1970 |
| DE | 20 14 828 | 10/1970 |
| DE | 2011493 | 10/1970 |
| DE | 27 32 012 | 1/1978 |
| DE | 218 121 | 1/1985 |
| DE | 36 11 947 | 10/1987 |
| DE | 42 19 658 | 12/1993 |
| DE | 4306925 | 9/1994 |
| DE | 4 309 416 | 10/1994 |
| DE | 43 122 19 | 10/1994 |
| DE | 44 09 609 | 10/1994 |
| DE | 44 19 441 | 12/1995 |
| DE | 44 26 966 | 2/1996 |
| DE | 4439149 | 5/1996 |
| DE | 44 19 440 | 6/1996 |
| DE | 295 04 127 | 8/1996 |
| DE | 19504316 | 8/1996 |
| DE | 195 11 151 | 10/1996 |
| DE | 19 753 806 | 6/1998 |
| DE | 19 717 257 | 10/1998 |
| DE | 197 21 609 | 11/1998 |
| DE | 19837210 | 11/1999 |
| DE | 69425098 | 7/2000 |
| DE | 19 915 235 | 10/2000 |
| DE | 19924508 | 11/2000 |
| DE | 10 037 923 | 3/2001 |
| DE | 100 23 391 | 3/2001 |
| DE | 100 37 923 | 3/2001 |
| DE | 100 16 307 | 10/2001 |
| DE | 100 19 660 | 11/2001 |
| DE | 10029044 | 1/2002 |
| DE | 100 60 877 | 7/2002 |
| DE | 100 60 879 | 7/2002 |
| DE | 10 200 405 | 8/2002 |
| DE | 10206089 | 8/2002 |
| DE | 102 23 268 | 1/2003 |
| DE | 10 200 406 | 7/2003 |
| DE | 10 204 381 | 8/2003 |
| DE | 69913117 | 8/2004 |
| DE | 10314878 | 10/2004 |
| EP | 0 172 001 | 2/1986 |
| EP | 0356419 | 2/1990 |
| EP | 04 94 851 | 7/1992 |
| EP | 584318 | 3/1994 |
| EP | 0 626 198 | 11/1994 |
| EP | 641877 | 3/1995 |
| EP | 0 662 204 | 7/1995 |
| EP | 0 662 264 | 7/1995 |
| EP | 0 789 822 | 8/1997 |
| EP | 0818469 | 1/1998 |
| EP | 0 853 146 | 7/1998 |
| EP | 0789790 | 1/1999 |
| GB | 1 311 146 | 3/1973 |
| GB | 2 007 147 | 5/1979 |
| GB | 1 583 265 | 1/1981 |
| JP | 59-228012 | 12/1984 |
| JP | 64-01052809 | 2/1989 |
| JP | 03-076822 | 4/1991 |
| WO | WO 93/19230 | 9/1993 |
| WO | 94/06530 | 3/1994 |
| WO | WO 94/08162 | 4/1994 |
| WO | WO 94/18983 | 9/1994 |
| WO | WO 94/20656 | 9/1994 |
| WO | 94/28210 | 12/1994 |
| WO | 94/28215 | 12/1994 |
| WO | 94/28219 | 12/1994 |
| WO | WO 94/28218 | 12/1994 |
| WO | WO 95/01470 | 1/1995 |
| WO | WO 95/01473 | 1/1995 |
| WO | WO 95/04173 | 2/1995 |
| WO | WO 95/05173 | 2/1995 |
| WO | 95/08010 | 3/1995 |
| WO | 95/11261 | 4/1995 |
| WO | WO 96/07777 | 3/1996 |
| WO | WO 96/17118 | 6/1996 |
| WO | WO 96/18760 | 6/1996 |
| WO | WO 96/20300 | 7/1996 |
| WO | WO 96/21758 | 7/1996 |
| WO | 96/27035 | 9/1996 |
| WO | 96/33221 | 10/1996 |
| WO | 96/33934 | 10/1996 |
| WO | WO 96/30566 | 10/1996 |
| WO | 96/38625 | 12/1996 |
| WO | WO 97/33020 | 9/1997 |
| WO | 98/05702 | 2/1998 |
| WO | WO 98/18983 | 5/1998 |
| WO | WO 98/19230 | 5/1998 |
| WO | WO 98/28218 | 7/1998 |
| WO | WO 99/00185 | 1/1999 |
| WO | WO 00/06813 | 2/2000 |
| WO | 01/27161 | 4/2001 |
| WO | WO 01/58960 | 8/2001 |
| WO | WO 01/68958 | 9/2001 |
| WO | WO 01/74906 | 10/2001 |

| | | |
|---|---|---|
| WO | 01/88232 | 11/2001 |
| WO | 01/88419 | 11/2001 |
| WO | WO 03/057952 | 7/2003 |
| WO | WO 03/064735 | 8/2003 |
| WO | WO 03/069200 | 8/2003 |
| WO | WO 03/080906 | 10/2003 |
| WO | WO 03/100140 | 12/2003 |
| WO | WO 2004/088010 | 10/2004 |
| WO | 2005/113868 | 12/2005 |
| WO | 2005/113869 | 12/2005 |
| WO | 2005/113870 | 12/2005 |

OTHER PUBLICATIONS

Taschenbuch für Heizung- und Klimatechnik 68, Auflage 1997/1998, Recknagel-Sprenger-Schramek, ISBN 3-486-26214-9, pp. 1073, 1074, 1247, 1248, 1438, 1613, 1614.

"Was Ist Neu an Den Neuen Fasern Der Gattung Lyocell". (What is new in the New Fibres of the Lyocell Type?), Lenzinger Berichte (Lenzinger Reports), Sep. 1994, pp. 37-40.

"Strukturbildung von Cellulosefasern Aus Aminoxidlösungen", (Structure Formation of Cellulose Fibres from Amine Oxide Solutions), Lenzinger Berichte (Lenzinger Reports), Sep. 1994, pp. 31-35.

International Search Report for International Application No. PCT/EP2002/012591 Issued on Mar. 27, 2003.

Jing, Y., "To improve the quality of feeding air of a spinning air conditioner," Jinshan Oil and Chemical Fibers (2000) 3:35-38.

Buijtenhuijs, F.A. et al., "The degradation and stabilization of cellulose dissolved in N-methylmorpholine-n-oxide (NMMNO)," Papier 40:12 (1986) 615-619.

* cited by examiner

SPINNING DEVICE AND METHOD HAVING COOLING BY BLOWING

The present invention relates to an apparatus for producing continuously molded bodies from a molding material, such as a spinning solution containing cellulose, water and tertiary amine oxide, the apparatus comprising a multitude of extrusion orifices through which during operation the molding material can be extruded into continuously molded bodies, a precipitation bath and an air gap arranged between the extrusion orifices and the precipitation bath, the continuously molded bodies being guided in successive order through the air gap and the precipitation bath during operation and a gas stream being directed in the area of the air gap onto the continuously molded bodies.

The fundamentals of the production of continuously molded bodies, such as lyocell fibers, from a spinning solution containing cellulose, water and tertiary amine oxide, preferably N-methylmorpholine-N-oxide (NMMNO) are described in U.S. Pat. No. 4,246,221. Thus, continuously molded bodies are substantially produced in three steps: First the spinning solution is extruded through a multitude of extrusion orifices to obtain continuously molded bodies. The continuously molded bodies are then stretched in an air gap—whereby the desired fiber strength is set—and are subsequently guided through a precipitation bath where they coagulate.

The advantage of lyocell fibers or corresponding continuously molded bodies lies, on the one hand, in a particularly environmentally friendly production process which permits an almost complete recovery of the amine oxide and, on the other hand, in the excellent textile properties of the lyocell fibers.

The process, however, poses problems insofar as the freshly extruded continuously molded bodies show a strong surface tackiness, which will only be reduced upon contact with a precipitant. Therefore, when the continuously molded bodies are passed through the air gap, there is the risk that the continuously molded bodies will contact one another and immediately stick together or conglutinate. The risk of conglutinations can be reduced by matching the operation and process parameters, such as tensile stress in the air gap, air gap height, filament density, viscosity, temperature and spinning velocity. However, when such conglutinations occur, this will affect the manufacturing process and fiber quality in a negative way because the conglutinations may lead to breaks and thickened portions in the continuously molded bodies. In the most adverse case the manufacturing method must be interrupted and the spinning process must be started once again, which entails high costs.

Nowadays, a spinning process without conglutinations is demanded from the manufacturers of continuously molded bodies, for instance from the yarn manufacturers as part of the textile processing chain, i.e. the individual filament stacks must not stick together because otherwise there will be irregularities e.g. in the yarn thickness.

A high profitability in the production of lyocell fibers, mainly staple fibers and filaments, however, can only be achieved when the spinneret orifices are arranged at a small distance from one another. A small distance, however, increases the risk of conglutinations in the air gap due to an incidental contact of the continuously molded bodies.

For improving the mechanical and textile properties of lyocell fibers, it is of advantage if the air gap is as large as possible because in the case of a large air gap the stretching of the filaments is distributed over a greater running length and stresses arising in the continuously molded bodies that are just being extruded can be reduced more easily. However, the larger the air gap, the lower is the spinning stability or the greater is the risk that the manufacturing process must be interrupted because of the conglutinations of the spun filaments.

Starting from the fundamentals of U.S. Pat. No. 4,246,221, there are some solutions in the prior art in which the attempt is made to improve both the economic efficiency and the spinning stability in the production of continuously molded bodies from a spinning solution containing cellulose and tertiary amine oxide.

For instance, U.S. Pat. No. 4,261,941 and U.S. Pat. No. 4,416,698 describe a method in which the continuously molded bodies are brought into contact with a nonsolvent immediately after extrusion to reduce surface tackiness. Subsequently, the continuously molded bodies are guided through a precipitation bath. The additional wetting of the continuously molded bodies by the nonsolvent prior to their passage through the precipitation bath is however too complicated and expensive for commercial use.

Another approach of increasing the spinning density, i.e. the number of extrusion orifices per unit area, is taken in WO 93/19230: In the method described therein the continuously molded bodies are directly cooled immediately after their extrusion by horizontal blowing in a direction transverse to the extrusion direction with a cooling gas stream. This measure reduces the surface tackiness of the continuously molded bodies, and the air gap can be extended.

This solution, however, has the inherent problem that the cooling gas stream interacts with the extrusion process at the extrusion orifices and may affect it in a negative way. In particular, it has been found in the method of WO 93/19230 that the spun filaments have no uniform quality because not all of the filaments have been subjected to the cooling gas stream in the same way. The risk of sticking together is at any rate not satisfactorily reduced in the method of WO 98/19230.

To permit a uniform blowing of the continuously molded bodies immediately after their delivery from the extrusion orifices, the apparatus of WO 95/01470 employs a ring nozzle in which the extrusion orifices are distributed over a substantially circular surface. Blowing with a cooling air stream takes place through the center of the ring nozzle and through the circular ring of the continuously molded bodies in radial direction horizontally to the outside. The air flow is here kept in a laminar state when exiting from the blowing means. The configuration of a laminar air flow is obviously considerably enhanced by the air guiding means indicated in the patent specification.

WO 95/04173 refers to a constructional development of the ring nozzle and the blowing means that is substantially based on the apparatus of WO 95/01470.

Although the solutions of WO 95/01470 and WO 95/05173 actually bring about a more uniform blowing operation, the ring arrangement of the continuously molded bodies leads to problems when the continuously molded bodies are passed through the precipitation bath: since the continuously molded bodies immerse as a circular ring into the precipitation bath and entrain the precipitation liquid in the precipitation bath, a region having an insufficient supply of precipitation liquid is created in the area between the continuously molded bodies, which results in a compensating flow through the ring of the continuously molded bodies and in an agitated precipitation bath surface, which in turn entails the conglutination of the fibers. Moreover, it is also found with the solutions of WO 95/01470 and WO 95/04173 that it is very difficult to control the extrusion conditions that are essential for the mechanical and textile product characteristics and that prevail at the extrusion orificies.

As an alternative to the ring nozzle arrangements, segmented rectangular nozzle arrangements have been developed in the prior art, i.e. nozzles having the extrusion orifices arranged substantially in rows on a substantially rectangular base area. Such a segmented rectangular nozzle arrangement is outlined in WO 94/28218. In this apparatus, blowing is carried out with a cooling air stream in a direction transverse to the extrusion direction, the cooling air stream extending along the longer side of the rectangular nozzle arrangement. After passage through the continuously molded bodies the cooling air stream is again sucked off in the apparatus of WO 94/28218. The suction is necessary so that the air current can be passed through the whole cross-section of the air gap.

The concept of rectangular nozzles with extrusion orifices arranged in rows has been developed further in WO 98/18983. It is the objective of WO 98/18983 that the extrusion orifices in one row are spaced apart differently than the rows of the extrusion orifices among one another.

Finally, WO 01/68958 describes a blowing operation in a direction substantially transverse to the direction of passage of the continuously molded bodies through the air gap with a different goal. Blowing by means of an air flow is not meant for cooling the continuously molded bodies, but for calming the precipitation bath surface of the precipitation bath in the area where the continuously molded bodies immerse into the precipitation bath and the spinning funnel, respectively: According to the teachings of WO 01/68985, the length of the air gap can be increased considerably when the blowing process becomes effective at the immersion points of the capillary bundles into the precipitation bath so as to calm the movement of the spinning bath surface. It is assumed that the strong bath turbulence that is typical of spinning funnels is reduced by performing a calming blowing operation on the spinning bath surface in that a liquid transport through the spun filaments is induced by the blowing process on the precipitation bath surface. To this end just a weak air flow is provided according to the teachings of WO 01/68958. It is essential in the teaching of WO 01/68958 that the blowing operation is performed shortly before the entry of the continuously molded bodies into the spinning bath surface. However, at the velocities of the air flow indicated in WO 01/68958 and at the location where the air flow is used for calming the spinning bath, no cooling effects can be achieved any more in the continuously molded bodies.

Thus, in the apparatus of WO 01/68958, in addition to the blowing operation described therein, which is performed shortly before the entry of the continuously molded bodies into the spinning bath surface, a cooling of the spun filaments near the extrusion orifices is also needed, as is known from the prior art. The additionally required cooling, however, results in a very expensive system.

In the light of the drawbacks of the solutions known from the prior art, it is the object of the present invention to provide an apparatus and a method which allow at only a small constructional effort, a combination of large air gap lengths with a high spinning density at a high spinning stability.

According to the invention this object is achieved for a spinning apparatus as indicated at the outset in the air gap directly after extrusion comprises a shielding zone and a cooling area separated by the shielding zone from the extrusion orifices, the cooling area being defined by the gas stream designed as the cooling gas stream.

The cooling area is thus the area in which the cooling gas stream impinges on the continuously molded bodies and cools the same.

Surprisingly, this solution yields a higher spinning density and a longer air gap than in conventional apparatus in which the cooling area extends directly to the extrusion orifices and a shielding zone does not exist.

It seems as if the shielding zone, i.e. the spacing of the cooling gas stream boundary from the extrusion orifices, prevents a cooling of the extrusion orifices and thus a negative effect on the extrusion process at the extrusion orifices, which process is extremely important for the development of the mechanical and textile properties. Hence, with the design according to the invention, the extrusion process can be carried out with parameters which can be exactly defined and exactly observed, in particular with an exact temperature control of the molding material up to the extrusion orifices.

One reason for the surprising effect of the solution according to the invention could be that the continuously molded bodies expand in an area immediately following extrusion. The tensile force which effects the stretching of the continuously molded bodies only becomes effective behind said expansion zone. In the expansion zone itself, the continuously molded bodies have no orientation yet and are largely anisotropic. The shielding zone obviously avoids an action of the cooling gas stream in the anisotropic expansion zone, which action is detrimental to the characteristics of the fibers. In the case of the solution according to the invention the cooling action seems to start when the tensile force acts on the continuously molded bodies and effects a gradual molecular alignment of the continuously molded bodies.

To prevent the surface of the precipitation bath from being agitated by the cooling gas stream, it is provided according to one particularly advantageous configuration of the apparatus that in addition to the first shielding zone the air gap comprises a second shielding zone by which the cooling area is separated from the surface of the precipitation bath. The second shielding zone prevents the cooling gas stream from contacting the precipitation bath surface in the immersion area of the filament bundles and produces waves that could mechanically stress the continuously molded bodies upon their entry into the precipitation bath surface. The second shielding zone is particularly useful when the cooling gas stream has a high velocity.

The quality of the continuously molded bodies produced can surprisingly be improved according to a further advantageous configuration if the inclination of the cooling gas stream in the direction of passage or extrusion is greater than the expansion of the cooling gas stream in the flow direction. In this embodiment, the cooling gas stream at each point in the area of the continuously molded bodies has a flow component which is oriented in the direction of passage and supports the stretching operation in the air gap.

A particularly good shielding or insulation of the extrusion process against the effect of the cooling gas stream is achieved when the distance of the cooling area from each extrusion orifice is at least 10 mm. At this distance even strong cooling gas streams can no longer act on the extrusion process in the extrusion orifices.

In particular, the distance I of the cooling area from each extrusion orifice in millimeters according to a further advantageous embodiment satisfies the following (dimensionless) inequality:

$$I>H+A\cdot[\tan(\beta)-0.14]$$

where H is the distance of the upper edge of the cooling gas stream from the plane of the extrusion orifices to the exit of the cooling gas stream in millimeters. A is the distance between the exit of the cooling gas stream and the row of the continuously molded bodies that is the last one in the direction of flow, in millimeters, in a direction transverse to the direction of passage, in which the continuously molded bodies are passed through the air gap, normally the horizontal direction. The angle in degrees between the cooling jet direction and the direction transverse to the direction of passage is designated as β. The cooling gas stream direction is substantially defined by the central axis or, in the case of planar cooling streams, by the central plane of the cooling gas stream. When this dimensioning formula is observed, the spinning quality and the spinning stability can surprisingly be improved to a considerable degree.

The angle β may assume a value of up to 40°. Independently of the angle β the value H should be greater than 0 at any rate to avoid any influence on extrusion process. The distance A may correspond at least to a thickness E of the curtain of the continuously molded bodies in a direction transverse to the direction of passage. The thickness E of the filament curtain is 40 mm at the most, preferably 30 mm at the most, even more preferably 25 mm at the most. The distance A may in particular be greater by 5 mm or, preferably by 10 mm, than the thickness E of the filament curtain.

Likewise, it has surprisingly been found that the spinning quality and the spinning stability are both increased if between the height L of the air gap in the direction of passage in millimeters, the distance I of the cooling area from the continuously molded bodies in the direction of passage in millimeters, the distance A between the exit of the cooling gas stream and the row of the continuously molded bodies that is the last one in the direction of flow, transversely to the direction of passage in millimeters, and the height B of the cooling gas stream in the direction of passage in millimeters, the following (dimensionless) relation is satisfied in the area of the air gap taken up by the continuously molded bodies:

$$L>I+0.28\cdot A+B$$

The apparatus according to the invention is in particular suited for producing continuously molded bodies from a spinning solution which prior to its extrusion has a zero shear viscosity of at least 10000 Pas, preferably of at least 15000 Pas, at 85° C. measuring temperature. Owing to the adjustment of the viscosity of the molding material, which is generally carried out by selecting the pulp type and the cellulose and water concentration in the spinning solution, a certain inherent or basic strength is imparted to the extrudate, so that stretching into molded bodies can be carried out. At the same time, the necessary viscosity range can be set by adding stabilizers and by guiding the reaction in the preparation of the solution.

According to a further variant, the spinning operation can be improved in that the cooling gas stream is designed as a turbulent stream, especially as a turbulent gas stream. So far it has probably been assumed in the prior art that a cooling effect in the case of lyocell spun filaments can only be performed by a laminar cooling gas stream because a laminar cooling gas stream produces a lower surface friction on the continuously molded bodies than a turbulent stream and the continuously molded bodies are therefore mechanically less loaded and moved.

Surprisingly, it has now been found that in the case of a turbulent cooling gas stream exiting at a high velocity from the blowing means with the same cooling capacity as in the case of a laminar cooling gas stream, considerably smaller amounts of blowing air or gas seem to be needed than has been assumed originally. Due to the reduced amount of blowing air, which is preferably achieved by reason of small cross-sections of the gas stream, the surface friction on the continuously molded bodies can be kept low despite a turbulent blowing, so that the spinning operation is not affected in a negative way.

The positive effect of the turbulent cooling gas stream is all the more astonishing because according to general fluid dynamics an improved cooling effect would have had to be expected with a turbulent flow only in the case of a small number of rows. To perform the spinning process in an economic way with a high hole density, a multitude of rows must be provided, so that according to fluid dynamics only a fraction of the continuously molded bodies should profit from the improved heat exchange conditions. Nevertheless, upon use of a turbulent cooling gas stream with a high velocity improved spinning characteristics were also obtained in the last rows most remote from the cooling gas stream.

Furthermore, one would have expected in the case of a turbulent cooling blowing operation carried out with a high velocity that the spun filaments would be blown away due to the high velocities and would thus stick together. Surprisingly, however, it has been found that the spun filaments are not impaired, but to the contrary upon use of small turbulent gas streams the gas demand can be reduced drastically and the risk of a sticking together is very small. Fiber titers of less than 0.6 dtex can be spun with turbulent cooling gas streams without any problem. The aspect of the turbulent gas stream cooling is advantageous in spinning methods also as such independently of the other developments of the invention.

A Reynolds number formed with the width of the cooling gas stream in the direction of passage and the velocity of the cooling gas stream can be at least 2,500, preferably at least 3,000, according to one configuration of the invention.

To penetrate a multitude of filament rows, it is very important that the cooling stream should be guided towards and passed through the bundles of filaments in an energy-intensive way. To meet this requirement, a blowing means for producing the cooling gas stream must be designed such that the specific blowing power is high on the one hand and that the distribution of the individual cooling streams as produced by the blowing means complies with the requirements of the bundles of filaments to be cooled on the other hand.

According to another advantageous variant the distribution of the individual cooling streams is to yield a substantially planar jet pattern (flat jet), the width of the substantially planar jet being bound to have at least the width of the filament curtain to be cooled. Preferably, the planar jet pattern distribution may also be formed by individual round, oval, rectangular or other polygonal jets arranged side by side; several rows disposed one above the other are also possible according to the invention for forming a planar jet pattern distribution.

The specific blowing power is defined as follows: A nozzle for producing the cooling gas stream with a rectangular (flat) jet pattern distribution and a maximum width of 250 mm is mounted in blowing direction perpendicular to a baffle plate mounted on a weighing device and having an area of 400×500 mm. The nozzle exit which forms the exit of the cooling gas stream out of the blowing means is spaced apart from the baffle plate with 50 mm. The nozzle is acted upon by compressed air with an overpressure of 1 bar and the power acting on the baffle plate is measured and divided by the width of the nozzle in millimeters. The resulting value is the specific blowing power of the nozzle with the unit [mN/mm].

In an advantageous design a nozzle has a specific blowing power of at least 5-10 mN/mm.

The rectangular nozzle may comprise several extrusion orifices arranged in rows; the rows may here be staggered in the direction of the cooling gas stream. To achieve a high impact of the cooling gas stream also in the row of the continuously molded bodies that is the rearmost one in the direction of the cooling gas stream, the number of the extrusion orifices in the direction of the rows may be greater than in the direction of the cooling gas stream in the case of the rectangular nozzle.

If rectangular nozzles are used, the deflection of the continuously molded bodies may particularly take place as a substantially planar curtain within the precipitation bath towards the precipitation bath surface, so that the continuously molded bodies can be bundled, i.e. converged towards an imaginary point, outside the precipitation bath.

The above-stated object is also achieved by a method for producing continuously molded bodies from a molding material, such as a spinning solution containing water, cellulose and tertiary amine oxide, the molding material being first extruded to obtain continuously molded bodies, the continuously molded bodies being then passed through an air gap and stretched in said air gap and blown at with a gas stream and cooled, and the continuously molded bodies being then guided through a precipitation bath. The continuously molded bodies in the air gap are first passed through a shielding zone and then through a cooling area where they are cooled by the cooling gas stream in the cooling area.

The invention shall now be described in more detail with reference to embodiments and test examples.

First of all, the construction of an apparatus according to the invention shall be described with reference to FIG. 1.

Figure 1:
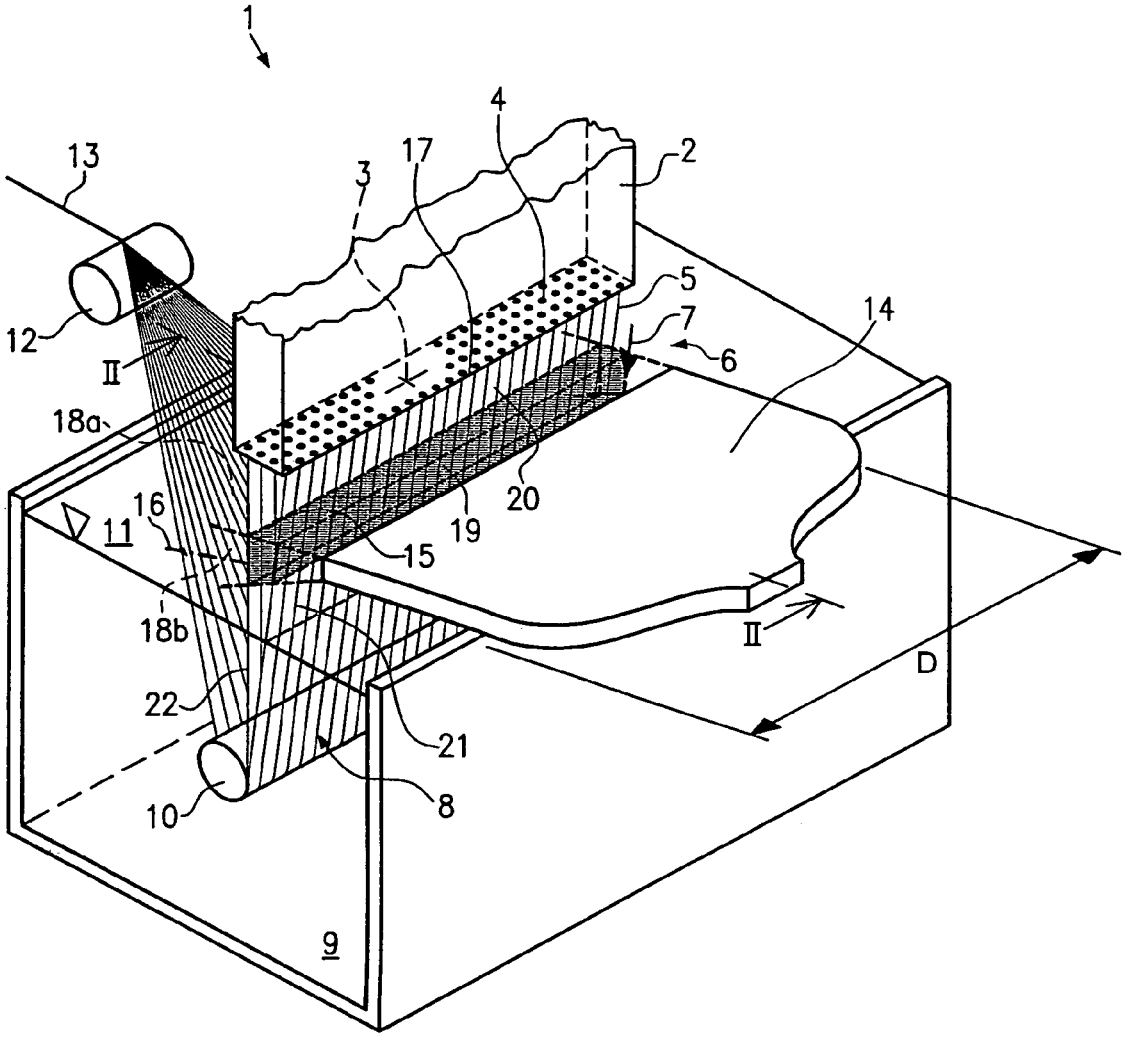
FIG. 1 is a perspective illustration of an apparatus according to the invention in a schematic overall view.

FIG. 1 shows an apparatus 1 for producing continuously molded bodies from a molding material (not shown). The molding material may, in particular, be a spinning solution containing cellulose, water and tertiary amine oxide. N-methylmorpholine-N-oxide may be used as the tertiary amino oxide. The zero shear viscosity of the molding material at about. 85° C. is between 10000 and about 30000 Pas.

The apparatus 1 comprises an extrusion head 2 which is provided at its lower end with a substantially rectangular, fully drilled die plate 3 as the base. The die plate 3 has provided therein a multitude of extrusion orifices 4 that are arranged in rows. The number of rows shown in the figures is for illustration purposes only.

The molding material is heated and passed through the preferably heated extrusion orifices where a continuously molded body 5 is extruded through each extrusion orifice. As schematically shown in FIG. 1, each continuously molded body 5 is substantially in the form of a filament.

The continuously molded bodies 5 are extruded into an air gap 6 which is traversed by the bodies in a direction 7 of passage or extrusion. According to FIG. 1 the extrusion direction 7 may be oriented in the direction of gravity.

After having passed through the air gap 6, the continuously molded bodies 5 immerse as a substantially planar curtain into a precipitation bath 9 consisting of a precipitant, such as water. In the precipitation bath 9, there is a deflector 10 by which the planar curtain 8 is deflected from the extrusion direction into the direction of the precipitation bath surface as a curtain 11 and is guided to a bundling means 12 in this process. The planar curtain is combined or assembled by the bundling means 12 into a bundle of filaments 13. The bundling means 12 is arranged outside the precipitation bath 9.

As an alternative to the deflector 10, the continuously molded bodies may also be passed in the direction of passage 7 through the precipitation bath and exit through a spinning funnel (not shown) at the side opposite the precipitation bath surface 11, i.e., on the bottom side of the precipitation bath. This embodiment, however, is disadvantageous insofar as the consumption of precipitation bath liquid is high, turbulent flows are created in the spinning funnel and the separation of precipitation bath and fiber cable at the funnel exit poses problems.

In the area of the air gap 6 there is disposed a blowing means 14 from which a cooling gas stream 15 exits having an axis 16 extending in a direction transverse to the direction of passage 7, or which comprises at least one main flow component in said direction. In the embodiment of FIG. 1 the cooling gas stream 15 is substantially planar.

The designation "planar gas flow" means a cooling gas stream whose height B in a direction transverse to the direction 16 of the gas flow is smaller, preferably much smaller, than width D of the gas flow in the direction of rows, and which is spaced apart from solid walls. As can be seen in FIG. 1, the direction of width D of the gas flow extends along the long edge 17 of the rectangular nozzle 3.

The two boundary areas 18*a* and 18*b* of the cooling gas stream 15, of which 18*a* designates the upper boundary area facing the die plate 3 and 18*b* designates the lower boundary area facing the precipitation bath surface 11, define a cooling area 19. Since the temperature of the planar gas stream 15 is lower than the temperature of the continuously molded bodies 5, which are still heated up by the extrusion process, an interaction between the planar gas stream 15 and the continuously molded bodies 5 and thus a cooling and solidification of the continuously molded bodies takes place in the cooling area.

The cooling area 19 is separated from the extrusion orifices 4 by a first shielding zone 20 in which there is no cooling of the continuously molded bodies 5.

The cooling area 19 is separated from the precipitation bath surface 11 by a second shielding or insulation zone 21 in which there is also no cooling and/or no air movement.

The first shielding zone 20 has the function that the extrusion conditions directly prevailing at the extrusion orifices are as little affected as possible by the subsequent cooling operation by means of the cooling gas stream in the cooling area 19. By contrast, the second shielding zone 21 has the function to shield the precipitation bath surface 11 from the cooling gas stream and to keep it as calm as possible. One possibility of keeping the precipitation bath surface 11 calm consists in the feature that the air is kept as motionless as possible in the second shielding zone 21.

The blowing means 14 for producing the cooling gas stream 15 comprises a multi-duct nozzle with one or several rows, as is e.g. offered by the company Lechler GmbH in Metzingen, Germany. In this multi-duct nozzle, the cooling gas stream 15 is formed by a multitude of circular individual streams having a diameter between 0.5 mm and 5 mm, preferably around 0.8 mm, which after a running path depending on their diameter and flow velocity are united to form a planar gas stream. The individual streams exit at a rate of at least 20 m/s, preferably at least 30 m/s. Rates of more than 50 m/s are also suited for producing turbulent cooling gas streams. The specific blowing force of a multi-duct nozzle of such a type should be at least 5 mN/mm, preferably at least 10 mN/mm.

The thickness E of the curtain of continuously molded bodies 5, which is to be penetrated by the cooling gas stream, measured in a direction transverse to the direction of passage 7, is less than 40 mm in the embodiment of FIG. 1. Said thickness is substantially determined by a sufficient cooling effect being produced by the cooling gas-stream in the cooling area 16 in the row 22 of the continuously molded bodies 5 that is the last one in gas flow direction 16. Depending on the temperature and velocity of the cooling gas stream and on the temperature and velocity of the extrusion process in the area of the extrusion-orifices 4, thicknesses E of less than 30 mm or less than 25 mm are also possible.

Figure 2:
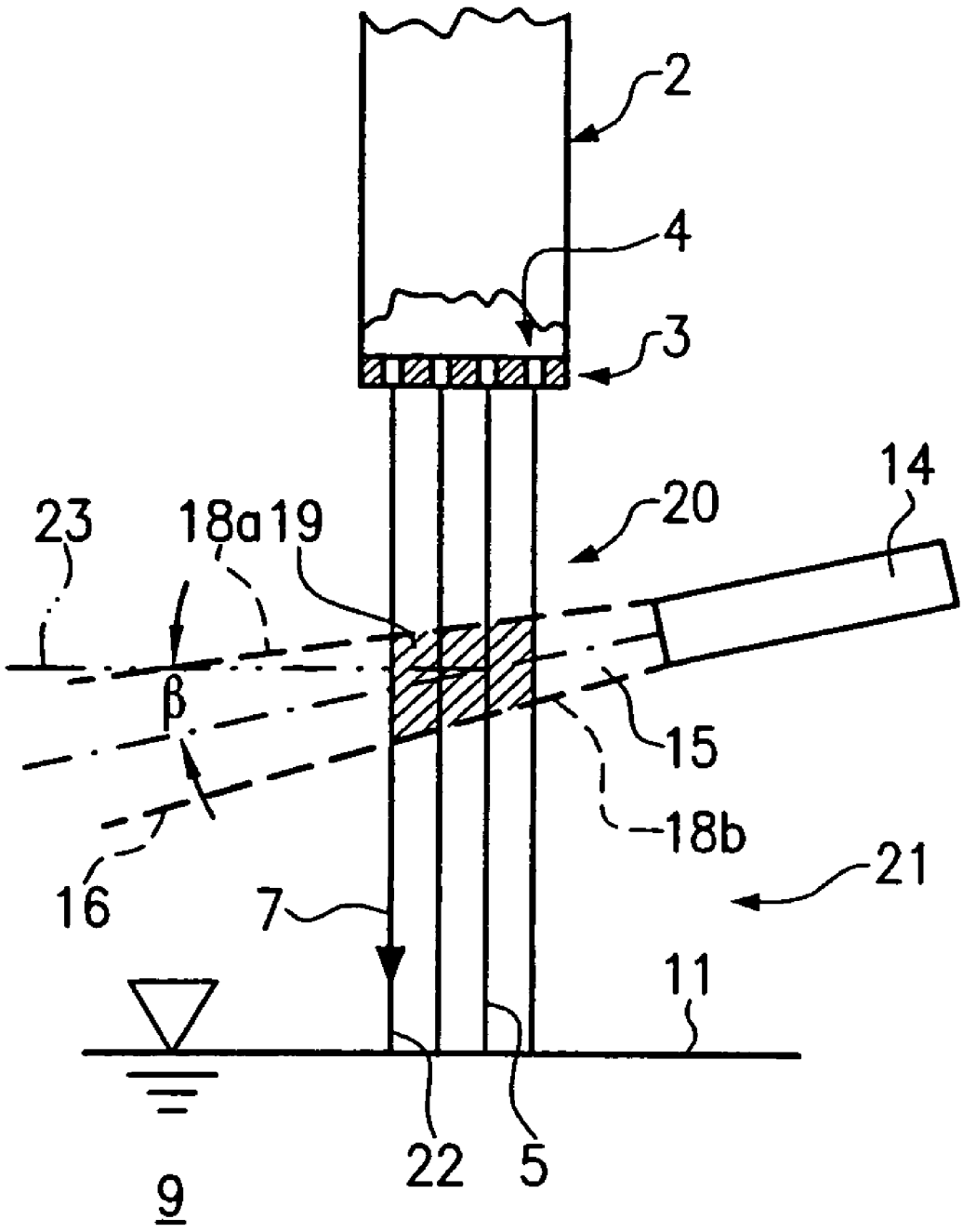
FIG. 2 shows a first embodiment of the apparatus illustrated in FIG. 1, in a schematic section taken along plane II-II of FIG. 1.

FIG. 2 depicts a special embodiment of the spinning apparatus 1 shown in FIG. 1. The same reference numerals are used in FIG. 2 for the elements of the apparatus 1 already described in FIG. 1. The embodiment is shown in a schematic section along plane 11 of FIG. 1, which forms the plane of symmetry in the direction of width D of the flow 15.

The dimensionless relation:

$$L>I+0.28\cdot A+B$$

is applicable between the height I of the shielding zone 20 measured in the direction of flow 7 in millimeters, the height L of the air gap 6 measured in the direction of flow 7, the distance A from the exit of the cooling gas stream 15 from the blowing means 14 to the last row 22 of the continuously molded bodies 5 in millimeters, and the width B of the cooling gas stream 15 in a direction transverse to the cooling gas stream direction 16.

Figure 3:
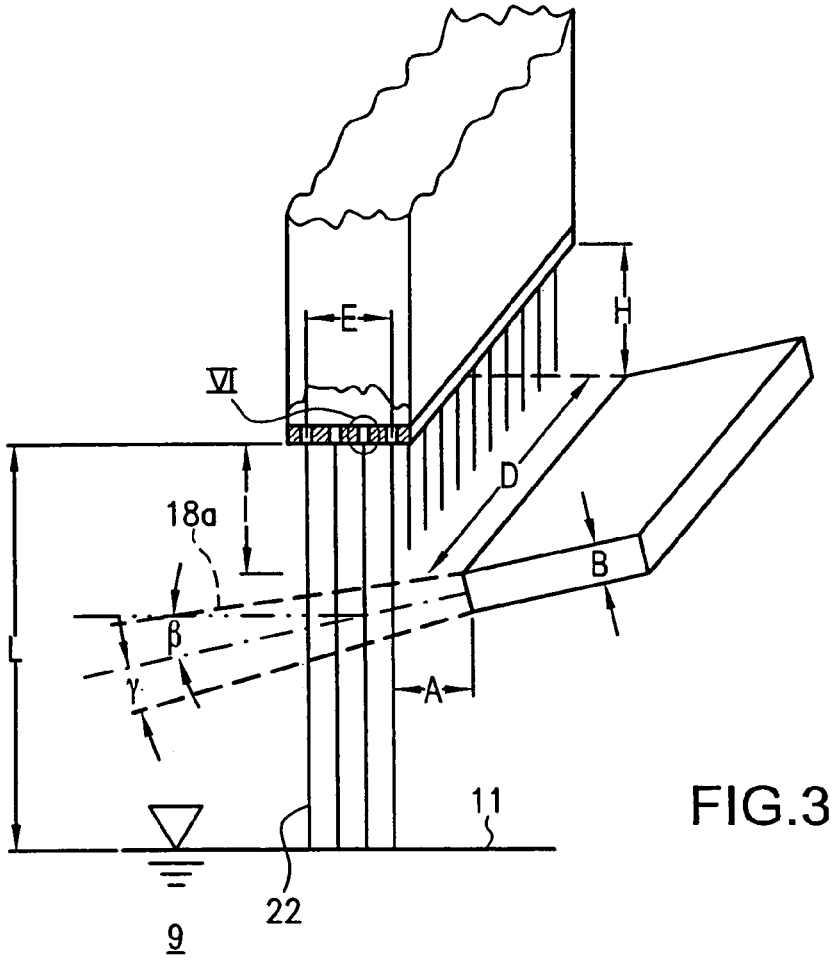
FIG. 3 is a schematic illustration of the apparatus of FIG. 1 for explaining geometrical parameters.

The distance A can here correspond at least to the thickness E of the curtain from continuously molded bodies 5, but may preferably be 5 mm or 10 mm greater than E. The sizes L, I, A, B are shown in FIG. 3.

When use is made of a cooling gas stream 15 having a round cross section, the diameter thereof can be taken instead of the width B of the cooling gas stream 15.

FIG. 2 shows an embodiment in which the direction 16 of the cooling gas stream 15 is inclined by an angle β relative to the vertical 23 towards the direction of inclination 7. The cooling gas stream 15 thereby has a velocity component which is oriented into the direction of passage 7.

In the embodiment of FIG. 2 the angle β is greater than the angle of propagation γ of the cooling gas stream. Due to this dimensioning rule the boundary area 18*a* between the gas flow 15 and the first shielding zone 20 extends in inclined fashion in the direction of passage 7. The angle β as shown in FIG. 2 may be up to 40°. At every location in the cooling area 19 the cooling gas stream 15 has a component oriented in the direction of passage 7.

In the embodiment of FIG. 2, apart from the already indicated inequality for the air gap height L, the following inequality is always satisfied, by which the height I of the first shielding zone 20 in the direction of passage 7 is determined. The following inequality is applicable:

$$I>H+A\cdot[\tan(\beta)0.14]$$

where the size H represents the distance in the direction of passage 7 between the extrusion orifices 4 and the upper edge of the cooling gas stream 15 directly at the exit from the blowing means 14.

In particular, the height of the first shielding zone 20 should nowhere be smaller than 10 mm in the area of the extrusion orifices.

Figure 4:
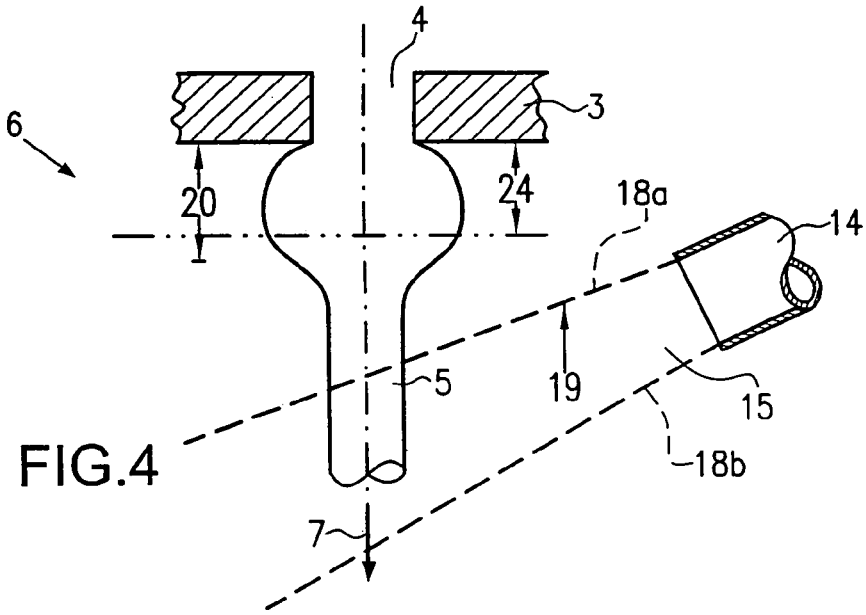
FIG. 4 is a schematic illustration for explaining the processes in a continuously molded body directly after extrusion.

The height I of the shielding zone can be explained as follows with reference to FIG. 4, which describes one embodiment. FIG. 4 shows detail VI of FIG. 3, where a single continuously molded body 5 is just shown by way of example directly after having exited from an extrusion orifice 4 into the air gap 6.

As can be seen in FIG. 4, the continuously molded body 5 is expanded directly after extrusion in an expansion zone 24 before being narrowed again under the action of the tensile force to about the diameter of the extrusion orifice 4. The diameter of the continuously molded body in a direction transverse to the direction of passage 7 may be up to three times the diameter of the extrusion orifice.

In the expansion zone 24, the continuously molded body still shows a relatively strong anisotropy which is gradually reduced in the direction of passage 7 under the action of the tensile force acting on the continuously molded body.

In contrast to the blowing methods and apparatuses known from the prior art, the shielding zone 20 extends in the solution of the invention according to FIG. 4 at least over the expansion zone 24. This prevents the cooling gas stream 15 from acting on the expansion zone.

According to the invention it is intended that the first shielding or protection zone 20 extends up to an area 25 in which the expansion of the continuously molded body 5 is either small or does not exist any more. As shown in FIG. 4, the area 25 in the direction of passage 7 is positioned behind the largest diameter of the expansion zone. Preferably, cooling area 19 and expansion zone 25 do not overlap, but directly follow one another.

The function of the spinning apparatus according to the invention and of the method according to the invention shall now be explained with reference to comparative examples.

In the illustrated examples and in the general table 1 there are indicated the spinning density, i.e. the number of extrusion orifices per square millimeter, the take off rate at which the bundle of filaments 12 is withdrawn, in meter/second, the molding material temperature in degree Celsius, the heating temperature of the extrusion orifices in degree Celsius, the air gap height in millimeter, the Reynolds number, the velocity of the cooling gas stream directly at the exit from the blowing means in meter/second, the distance H in millimeters, the angle β in degrees, the spun fiber titer in dtex, the coefficient of variation in percent, the subjectively evaluated spinning behavior with marks between 1 and 5, the width of the cooling gas stream or—in the case of a round cooling gas stream—the diameter thereof, as well as the amount of gas standardized by the width of the cooling gas stream in liter/hour per mm nozzle width. With mark 1, the spinning behavior is rated to be good, with mark 5 to be poor.

The coefficient of variation was determined according to DIN EN 1973 with the test device Lenzing Instruments Vibroskop 300.

The Reynolds number as a measure of the turbulence of a gas stream was determined in accordance with the formula $Re=w_0*B/\nu$, where $w_0$ is the exiting velocity of the air from the nozzle in m/s, B is the blow gap width or the hole diameter of the blowing apparatus, in mm, and $\nu$ is the kinematic viscosity of the gas. The kinematic viscosity $\nu$ was assumed to be $153.5\times10^{-7}$ $m^2/s$ for air at a temperature of 20° C. When other gases or gas mixtures are produced for generating a cooling gas stream, the value of $\nu$ can be adapted accordingly.

The general table 1 is a summary of the test results.

COMPARATIVE EXAMPLE 1

An NMMNO spinning material consisting of 13% cellulose type MoDo Crown Dissolving-DP 510-550, 76% NMMNO and 11% water was supplied at a temperature of 78° C., stabilized with gallic acid propylester, to an annular spinning nozzle having a ring diameter of about 200 mm. The spinning nozzle consisted of several drilled individual segments, each containing the extrusion orifices in the form of capillary bores. The extrusion orifices were heated to a temperature of 85° C.

The space between the precipitation bath surface and the extrusion orifices was formed by an air gap of about 5 mm height. The continuously molded bodies passed through the air gap without being blown at. The continuously molded bodies coagulated in the spinning bath in which a spinning funnel was arranged below the extrusion orifices.

The ring-like bundle of continuously molded bodies was bundled in the spinning funnel by the exit surface thereof and guided out of the spinning funnel. The length of the spinning funnel in the direction of passage was about 500 mm.

The spinning behavior turned out to be very problematic because the spun fiber material was sticking together at many points. The poor conditions also became obvious from a strong variation of the fiber fineness, the variance of which was at more than 30% in this comparative example.

COMPARATIVE EXAMPLE 2

In Comparative Example 2 a blowing operation directed from the outside to the inside was additionally carried out directly after extrusion without a first shielding zone under otherwise identical conditions. The blowing operation took place at a relatively low rate of about 6 m/s.

The blowing operation could increase the height of the air gap only insignificantly; the spinning quality and the spinning stability remained substantially unchanged in comparison with Comparative Example 1.

COMPARATIVE EXAMPLE 3

The molding material used in Comparative Examples 1 and 2 was supplied in the Comparative Example 3 at a temperature of also 78° C. to a rectangular nozzles which was composed of several drilled individual segments. The rectangular nozzle had three rows of individual segments kept at a temperature of about 90° C.

Underneath the extrusion orifices there was a precipitation bath in which a deflector was mounted. An air gap of about 6 mm through which the continuously molded bodies passed as a curtain was formed between the precipitation bath surface and the extrusion orifices. A cooling blowing in parallel with the spinning bath surface was used for supporting the spinning operation.

The continuously molded bodies were coagulated in the precipitation bath where the curtain consisting of continuously molded bodies was deflected by the deflector and supplied obliquely upwards to a bundling means arranged outside the precipitation bath. The curtain of the continuously molded bodies was united by the bundling means into a bundle of filaments and then passed on to further processing steps.

Comparative Example 3 showed a slightly improved spinning behavior, but spinning flaws were observed time and again. The continuously molded bodies were sticking together in part; the fiber fineness varied considerably.

COMPARATIVE EXAMPLE 4

In Comparative Example 4, a blowing means having a width B of 8 mm was mounted under otherwise identical conditions with respect to Comparative Example 3 on a long side of the rectangular nozzle in such a way that the cooling area extended up to the extrusion orifices, i.e. there was no first shielding zone.

The cooling gas stream had a velocity of about 10 m/s when exiting from the blowing means.

In comparison with Comparative Example 3, the air gap could only be increased insignificantly in the arrangement of Comparative Example 4, the achieved spinning stability as well as the fiber data remained unchanged in comparison with the values of Comparative Example 3.

COMPARATIVE EXAMPLE 5

Like in Comparative Example 4, a blowing means with a cooling gas stream width of 6 mm upon exit from the blowing means was mounted in this comparative example on a long side of the rectangular nozzle in such a way that the cooling area extended without an interposed shielding zone up to the extrusion orifices. In contrast to Comparative Example 4 a rectangular nozzle drilled all over its surface was used instead of a segmented rectangular nozzle.

The velocity of the cooling gas stream at the exit on the blowing means was about 12 m/s.

In Comparative Example 5 the air gap could be increased to about 20 mm and the spinning stability was improved considerably. As for the fiber data, however, no improvements were observed, especially since sticking occurred time and again.

In the following Comparative Examples 6 to 9, a cooling gas stream was produced by means of several multi-duct compressed-air nozzles arranged side by side in a row. The diameter of each compressed-air nozzle was about 0.8 mm. The exit velocity of the individual cooling gas streams from the blowing means was more than 50 m/s in Comparative Examples 6 to 8. The individual cooling streams were turbulent. The gas supply of the nozzle was carried out with compressed air of 1 bar overpressure; the gas stream was throttled by means of a valve for adapting the blowing velocity.

The spinning head comprised a rectangular nozzle of special steel that was drilled all over its surface. Otherwise, the spinning system of Comparative Examples 3 to 5 was used.

COMPARATIVE EXAMPLE 6

Like in Comparative Example 5, the multi-duct compressed-air nozzle was mounted in Comparative Example 6 in such a way that the cooling area extended directly to the extrusion orifices, i.e., there was no first shielding zone.

In this arrangement no improved results were observed; the spinning characteristics could not be rated as satisfactory.

COMPARATIVE EXAMPLE 7

In this test the cooling gas stream was directed obliquely upwards in the direction of the nozzle and therefore had a component opposite to the direction of passage.

In Comparative Example 8 the spinning characteristics were not as good as in Comparative Example 7.

COMPARATIVE EXAMPLE 8

In comparison with Comparative Example 7 the cooling gas stream had a flow direction obliquely downwards towards the spinning bath surface. Thus the cooling gas stream had a velocity component in the direction of passage.

In the arrangement according to Comparative Example 9 the best results could be achieved. The coefficient of variation of the continuously molded bodies was clearly below 10%. The spinning characteristics were highly satisfactory and left some room for finer titers or higher take-off rates.

It should here be noted that in Comparative Examples 6, 7 to 9 the cooling area and the precipitation bath surface had arranged thereinbetween a second shielding zone in which the air was substantially stationary.

GENERAL TABLE 1

| | | Example | | | | | | | |
|---|---|---|---|---|---|---|---|---|---|
| | | 1 | 2 | 3 | 4 | 5 | 6 | 7 | 8 |
| Hole density | | 1.86 | 1.96 | 1.86 | 0.99 | 2.81 | 3.18 | 3.18 | 3.18 |
| Take-off rate | | 40 | 30 | 30 | 32 | 34 | 31 | 35 | 40 |
| Spinning material temperature | | 78 | 78 | 78 | 83 | 81 | 83 | 83 | 84 |
| Nozzle heat temperature | | 85 | 85 | 80 | 100 | 98 | 100 | 100 | 102 |
| Air gap | L | 5 | 6 | 6 | 16 | 20 | 18 | 16 | 22 |
| Reynolds number | | | | 782 | 5,211 | 4,690 | 3,388 | 3,648 | 3,908 |
| Velocity at the cooling gas stream exit | | — | — | 6 | 10 | 12 | 65 | 70 | 75 |
| Distance between exit from blowing means and last row of the continuously molded bodies | A | — | — | 35 | 23 | 22 | 32 | 32 | 32 |
| Distance between the extrusion orifices and the upper edge of the cooling gas stream exit in the direction of passage | H | — | — | 0 | 0 | 0 | 0 | 10 | 10 |
| Blowing angle | β | — | — | 0 | 0 | 0 | 0 | −10 | 20 |
| Titer | | 1.72 | 1.66 | 1.74 | 1.55 | 1.4 | 1.47 | 1.35 | 1.33 |
| Coefficient of variation of the titer | | 30.3 | 23.5 | 25.8 | 18.5 | 24.3 | 18.6 | 21.1 | 7.6 |
| Spinning behavior | | 4-5 | 4 | 4-5 | 4 | 3 | 3-4 | 4 | 1-2 |
| Cooling stream width/ individual bore diameter | B | | | 2 | 8 | 6 | 0.8 | 0.8 | 0.8 |
| Gas quantity per mm width | | | | 43 | 288 | 259 | 39 | 42 | 45 |

As for the values of the General Table 1, it must be assumed in the case of the indicated flow velocities that there was a turbulent cooling gas stream at the high flow velocities of Comparative Examples 6 to 8.

The invention claimed is:

1. Apparatus for producing continuously molded bodies from a molding material comprising a multitude of extrusion orifices through which during operation the molding material is extruded into continuously molded bodies, a precipitation bath and an air gap arranged between the extrusion orifices and the precipitation bath, the continuously molded bodies being passed during operation in successive order through the air gap and the precipitation bath, and a gas stream being directed in the area of the air gap to the continuously molded bodies, wherein the air gap directly after extrusion comprises a shielding zone and a cooling area separated from the extrusion orifices by the shielding zone, the cooling area being defined by the gas stream designed as the cooling gas stream, and wherein the inclination (β) of the cooling gas stream in the direction of passage is greater than the expansion (γ) of the cooling gas stream.

2. The apparatus of claim 1, wherein the shielding zone prevents a cooling of the extrusion orifices.

3. The apparatus according to claim 1, wherein the air gap further comprises a second shielding zone by which the cooling area is separated from the precipitation bath surface.

4. The apparatus according to claim 1, wherein the width in the direction of passage of the shielding zone is dimensioned such that the shielding zone in the direction of passage extends at least over an expansion zone of the continuously molded bodies which directly follows extrusion and extends in the direction of passage.

5. The apparatus according to claim 1, wherein the extrusion orifices are arranged on a substantially rectangular base are in rows in a direction transverse to the direction of the cooling gas stream.

6. The apparatus according to claim 5, wherein the number of the extrusion orifices in row direction is greater than in the cooling gas stream direction.

7. The apparatus according to claim 1, wherein the precipitation bath has disposed therein a deflector by which during operation the continuously molded bodies are deflected as a substantially planar curtain to the precipitation bath surface, and that outside of the precipitation bath there is provided a bundling means by which during operation the continuously molded bodies are united to form a fiber bundle.

8. The apparatus according to claim 1, wherein the width (D) of the cooling gas stream in a direction transverse to the direction of passage of the continuously molded bodies through the air gap is larger than the height (B) of the cooling gas stream in the direction of passage.

9. The apparatus according to claim 1, wherein the cooling gas stream is composed of a plurality of individual cooling gas streams.

10. The apparatus according to claim 9, wherein the individual cooling gas streams are arranged side by side in row direction.

11. The apparatus according to claim 1, wherein the cooling gas stream is designed as a turbulent gas flow in the area where the continuously molded bodies are passed through the air gap.

12. The apparatus according to claim 1, wherein the cooling gas stream has a velocity component oriented into the direction of passage.

13. The apparatus according to claim 1, wherein the molding material prior to its extrusion has a zero shear viscosity of at least 10000 Pas, at 85° C.

14. The apparatus according to claim 1, wherein the distance of the cooling area from each extrusion orifice in the direction of passage is at least 10 mm each time.

15. The apparatus according to claim 1, wherein the distance I of the cooling area in the direction of passage from each extrusion orifice in millimeters satisfies the following inequality:

$$I>H+A\cdot[\tan(\beta)-0.14]$$

where H is the distance of the upper edge of the cooling gas stream in the direction of passage from the plane of the extrusion orifices at the exit from the blowing means in millimeters, A is the distance in a direction transverse to the direction of passage between the exit of the cooling gas stream of the blowing means in millimeters and the row of the continuously molded bodies that is the last one in flow direction, in millimeters, and β is the angle in degrees between the cooling gas stream direction and the direction transverse to the direction of passage.

16. The apparatus according to claim 1, wherein the height L of the air gap in the direction of passage in millimeters satisfies the following inequality:

$$L>I+0.28\cdot A+B$$

where I is the distance of the cooling area from the extrusion orifices in the area where the continuously molded bodies are passed through the air gap, A is the distance in a direction transverse to the direction of passage between the exit of the cooling gas stream from the blowing means and the row of the continuously molded bodies that is the last one in flow direction, in millimeters, and B is the height of the cooling gas stream in a direction transverse to the cooling gas stream direction in the direction of passage at the exit of the cooling gas stream from the blowing means.

17. The apparatus according to claim 1, wherein the first shielding zone consists essentially of air.

18. A method for producing continuously molded bodies from a molding material, the molding material being first extruded through a multitude of extrusion orifices to obtain continuously molded bodies, the continuously molded bodies being then passed through an air gap and stretched in said air gap and blown at with a gas stream, and the continuously molded bodies being then guided through a precipitation bath, wherein the continuously molded bodies in the air gap are first passed through a shielding zone and then through a cooling area, the shielding zone preventing a cooling of the extrusion orifices, and the blowing operation being performed in the cooling area by means of the gas stream designed as the cooling gas stream, and wherein the inclination (β) of the cooling gas stream in the direction of passage is greater than the expansion (γ) of the cooling gas stream.

19. The method according to claim 18, wherein the continuously molded bodies after the cooling area are passed through a second shielding zone before they immerse into the precipitation bath.

20. The method according to claim 18, wherein the velocity of the cooling gas stream, $w_0$, in dependence upon its width B, is set in the direction of passage of the continuously molded bodies by the air gap such that the Reynolds number formed with $w_0$ and B is at least 2500.

21. The method according to claim 18, wherein the specific blowing power of the cooling gas stream is set to a value of at least 5 mN/mm.

22. A method for reducing the surface tackiness of a molding material during molding, comprising:

(a) extruding the molding material through a multitude of extrusion orifices to obtain continuously molded bodies;

(b) stretching the continuously molded bodies through an air gap, the air gap comprising a shielding zone and a cooling area, wherein the shielding zone prevents a cooling of the extrusion orifices, and the continuously molded bodies are blown at with a cooling gas stream in the cooling area, thereby reducing the surface tackiness of the molding material, wherein the inclination (β) of the cooling gas stream in the direction of passage is greater than the expansion (γ) of the cooling gas stream; and (c) guiding the continuously molded bodies through a precipitation bath.

23. The method of claim 22, wherein the molding material is a spinning solution comprising water, cellulose and tertiary amine oxide.

24. The method of claim 18, wherein the molding material is a spinning solution comprising water, cellulose and tertiary amine oxide.

* * * * *